United States Patent [19]

Bourgade

[11] 4,090,338

[45] May 23, 1978

[54] PARQUET FLOOR ELEMENTS AND PARQUET FLOOR COMPOSED OF SUCH ELEMENTS

[75] Inventor: Pierre Bourgade, Melun, France

[73] Assignee: B 3 L, Creteil, France

[21] Appl. No.: 749,969

[22] Filed: Dec. 13, 1976

[51] Int. Cl.[2] ..... E04F 13/08; E04C 1/30

[52] U.S. Cl. ..... 52/392; 52/591; 52/594

[58] Field of Search ..... 52/392, 589, 592, 593, 52/390, 385, 574, 594; 404/40, 41, 46

[56] References Cited

U.S. PATENT DOCUMENTS

| | | | |
|---|---|---|---|
| 1,978,075 | 10/1934 | Butterworth | 52/589 X |
| 2,189,218 | 2/1940 | Neumeister | 52/589 X |
| 2,914,815 | 12/1959 | Alexander | 52/589 |
| 3,247,638 | 4/1966 | Gay, Jr. | 52/392 |
| 3,554,850 | 1/1971 | Kuhle | 52/392 |
| 3,657,852 | 4/1972 | Worthington et al. | 52/392 X |

FOREIGN PATENT DOCUMENTS

| | | | |
|---|---|---|---|
| 303,324 | 1/1929 | United Kingdom | 52/392 |

*Primary Examiner*—Price C. Faw, Jr.
*Assistant Examiner*—Robert C. Farber

[57] ABSTRACT

A parquet floor element is disclosed which comprises a facing layer defined by edges forming a closed contour, a backing panel of indented peripheral shape, and means for fixing the facing layer to the backing panel, the latter being associated with the facing layer in such a manner that the said teeth partly project relative to the edges of the facing layer, the intervals between the teeth in part receding relative to the said edges with a regular sequence, along the whole of the contour of the facing layer, of teeth projecting relative to the said edges and intervals between the teeth receding relative to the said edges.

4 Claims, 5 Drawing Figures

PARQUET FLOOR ELEMENTS AND PARQUET FLOOR COMPOSED OF SUCH ELEMENTS

The object of the invention is a parquet floor element and a parquet floor realised with the aid of such elements.

It has already been proposed, for example in French Pat. No. 435,241, to provide a parquet floor constituted by the assembly of elements, each of which comprises a facing panel glued or otherwise fixed to a backing panel having indented edges, the indentations being in part receding and in part projecting relative to the straight edges of the panel. In this element, with a square facing panel, the indentations of the backing panel are such that the said panel does not run flush with two of the angles of the element when the panel is in position in the two other angles. The result thereof is that the assembly of such elements cannot be realised otherwise than according to a preferred design, and, in addition, the parquet floor obtained with the aid of these elements may have defects with regard to planeness and stability in its zones corresponding to the angles of the adjacent elements.

In general terms, an object of the invention is to provide a parquet floor element which remedies the disadvantages mentioned above.

With this end in view, an object of the invention is to provide a parquet floor element in which the configuration of the backing panel is such that it can be assembled in any desired manner with the adjoining elements.

It is also an object of the invention to provide a parquet floor element, the connection of which with the adjacent element leads to a parquet floor having an excellent stability and planeness.

A parquet floor element according to the invention, comprising a facing layer fixed to a backing panel with indented edges, these edges partly projecting relative to the edges of the backing layer and the intervals between the projections in part receding relative to the said edges, is characterised in that the backing panel is shaped and arranged relative to the facing layer in such a manner that along the whole of the periphery of the facing layer there is a regular sequence of teeth projecting relative to the edges of the said layer and intervals between the teeth receding relative to the said edges.

The invention will be better understood by the description which follows given by way of example and with reference to the attached drawing in which.

Figure 1:
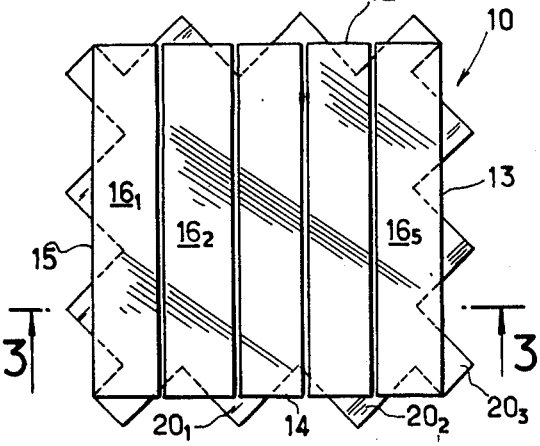
FIG. 1 is a plan view of an element according to the invention for a first embodiment.
Figure 2:
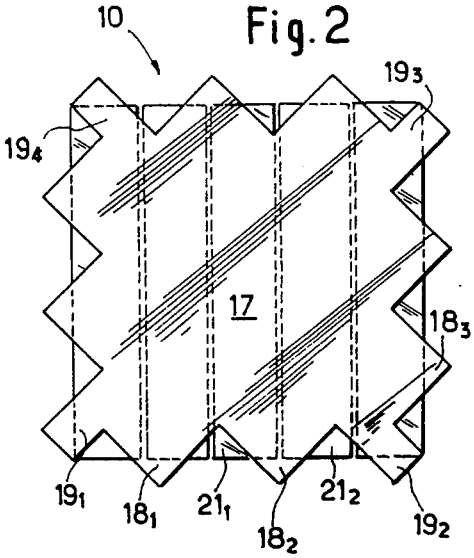
FIG. 2 is a view from the direction of the other face.
Figure 3:
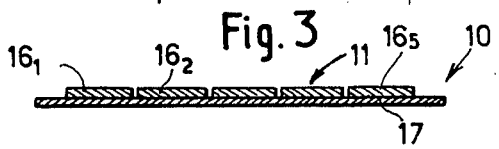
FIG. 3 is a sectional view taken along the line 3—3 of FIG. 1.

A parquet floor element according to the invention, 10, FIGS. 1 to 3, comprises a facing layer 11, with edges 12, 13, 14 and 15, and which may be made up of a single piece or, as illustrated, constituted by separate sheets $\mathbf{16}_1$, $\mathbf{16}_2 \ldots \mathbf{16}_5$.

Whether it is integrally constructed or not, the thickness of the facing layer 11 is smaller than that of a conventional parquet floor board, for example 3 to 6 mm and is advantageously made of wood treated by impregnation to impart thereto good strength qualities.

On the backing face of layer 11 is fixed, by any appropriate means, for example by gluing, a panel 17 made of a material which is less expensive than that constituting the facing layer, for example of plywood, the thickness of which may be of the order of 4 to 8 mm. As can be clearly seen in FIG. 2, the backing panel 17 is cut on its edges along the teeth $\mathbf{18}_1$, $\mathbf{18}_2$, $\mathbf{18}_3$, and so on, in the form of rightangled isosceles triangles, whilst its corners possess rectangular tongues $\mathbf{19}_1$, $\mathbf{19}_2$, $\mathbf{19}_3$ and $\mathbf{19}_4$.

The dimensions of the facing layer 11 and of the backing panel 17, as well as their relative arrangement, are such that the teeth 18, the tongues 19 and the intervals between teeth and the intervals between tongues and teeth define, along the periphery of the element 10, a regular sequence of projecting triangular portions $\mathbf{20}_1$, $\mathbf{20}_2$, $\mathbf{20}_3$, and so on, separated by portions $\mathbf{21}_1$, $\mathbf{21}_2$, and so on, of the backing panel 17 which recede relative to the edges 12–15 of the facing layer, the said portions 21 having the contour of a rightangled triangle complementary to that of the projecting portions 20.

Figure 4:
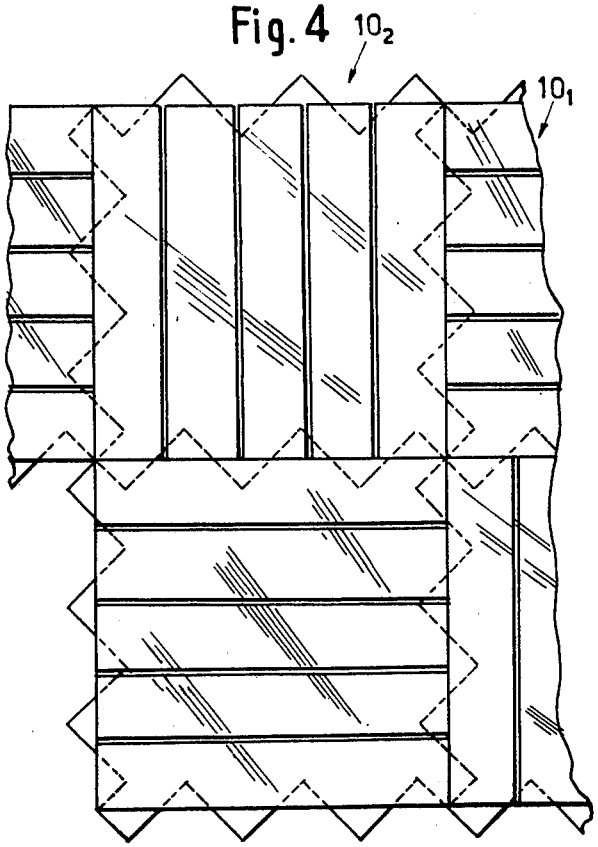
FIG. 4 is a partial view of a parquet floor according to the invention realised with the aid of the elements according to FIGS. 1 to 3.

To construct a parquet floor, the elements 10 are placed side by side along their edges, so as to fit the projecting portions 20 of an element $\mathbf{10}_1$ into the receding portions 21 of an adjacent element $\mathbf{10}_2$, the fixing of the elements to the ground or to an appropriate support being effected by gluing or by nailing in the portions 20, FIG. 4.

The presence of the regularly distributed projecting and receding portions along the whole of the periphery of the element makes possible a particularly simple assembly and alignment of the said elements to obtain a parquet floor, for example a parquet floor of chequered pattern, having the same good characteristics as the parquet floors constructed with the conventional boards, but being of substantially lower cost.

Figure 5:
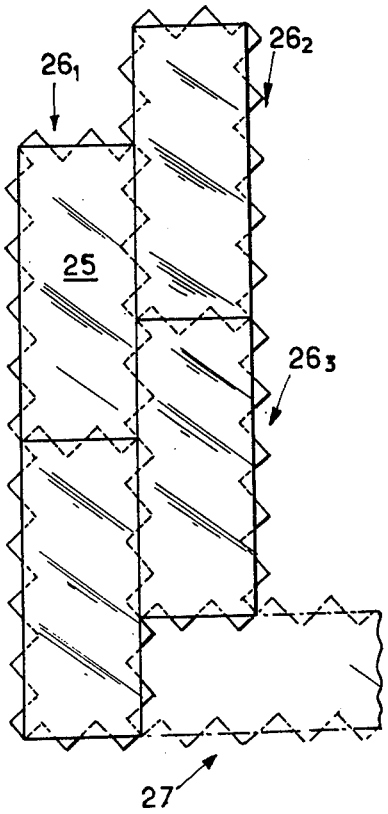
FIG. 5 is a view analogous to that of FIG. 4 but for another embodiment of an element according to the invention.

It is of course understood that the invention is not limited to the embodiment described above. Thus, the facing layer 25 may be of rectangular contour, as shown on FIG. 5 which illustrates, in solid lines, the assembly of elements $\mathbf{26}_1$, $\mathbf{26}_2$, $\mathbf{26}_3$, and so on, to form a herringbone pattern parquet floor, and which also illustrates, by the element 27 drawn in dot-and-dash lines, an assembly of elements by their longitudinal and transverse edges, made possible by the regularly alternating sequence of projecting and receding portions of the backing panel.

What I claim is:

1. A parquet floor element comprising:

a planar upper facing layer with four edges forming a right angled parallelepipedic periphery, a firm backing lower layer with a non-rectilinear periphery, means fixing the facing layer to the backing layer, such that said non-rectilinear periphery is formed by a number of alternating identical outwardly projecting teeth means and inwardly directed recesses with respect to said parallelepipedic periphery, whereby any edge of said element can be joined with any edge or portion of an edge of another of said element, said non-rectilinear periphery crossing said parallelepipedic periphery at substantially a 45° angle so as to allow a joining of any two successive edges of an element with the free perpendicular edges of two other such elements already laid down by a sliding motion parallel to the plane of said planar facing layer in a direction making substantially a 45° angle with the edges of said already laid down elements, in order to obtain a continuous backing layer for the flooring.

2. The parquet floor element of claim 1, wherein said teeth means and said recesses are substantially right angled isosceles triangles.

3. The parquet floor element of claim 2, wherein said parallelepipedic periphery is substantially a square and the sequence of said teeth means and said recesses is such that they form substantially an identical pattern along each edge of said square.

4. The parquet floor element of claim 2, wherein said parallelepipedic periphery is a rectangle.

* * * * *